US011380271B2

(12) United States Patent
Gu et al.

(10) Patent No.: US 11,380,271 B2
(45) Date of Patent: Jul. 5, 2022

(54) BACKLIGHT DRIVING METHOD, DISPLAY DRIVING METHOD, DRIVE DEVICE AND DISPLAY DEVICE

(71) Applicants: BOE MLED TECHNOLOGY CO., LTD., Beijing (CN); BOE TECHNOLOGY GROUP CO., LTD., Beijing (CN)

(72) Inventors: Qibing Gu, Beijing (CN); Wei Hao, Beijing (CN); Rui Liu, Beijing (CN); Lingyun Shi, Beijing (CN); Wei Sun, Beijing (CN); Ming Chen, Beijing (CN); Hong Yang, Beijing (CN)

(73) Assignees: BOE MLED TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/772,226

(22) PCT Filed: Jul. 31, 2019

(86) PCT No.: PCT/CN2019/098702
§ 371 (c)(1),
(2) Date: Jun. 12, 2020

(87) PCT Pub. No.: WO2021/016943
PCT Pub. Date: Feb. 4, 2021

(65) Prior Publication Data
US 2021/0407441 A1 Dec. 30, 2021

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2310/08* (2013.01); *G09G 2320/0257* (2013.01); *G09G 2320/0686* (2013.01)

(58) Field of Classification Search
CPC .... G09G 3/3426; G09G 3/36; G09G 2310/08; G09G 2320/0257; G09G 2320/0686
See application file for complete search history.

(56) References Cited

U.S. PATENT DOCUMENTS

2011/0279485 A1* 11/2011 Jang ..... G09G 3/342 345/690
2015/0279290 A1* 10/2015 Nakahata ..... G09G 3/2092 345/549

* cited by examiner

*Primary Examiner* — Towfiq Elahi
(74) *Attorney, Agent, or Firm* — Leason Ellis LLP

(57) ABSTRACT

Disclosed are a backlight driving method, a display driving method, a drive device and a display device. The backlight driving method includes: receiving a frame of backlight data, wherein the frame of backlight data includes a plurality of first control signals which are respectively applied to the plurality of switching channels and serve as the switching control signals, and a plurality of second control signal groups respectively corresponding to the plurality of first control signals, each of the plurality of second control signal groups includes a plurality of second control signals which are respectively applied to the plurality of output channels and serve as the output control signals, and the plurality of first control signals are modulated non-constant width pulse signals respectively; and driving the backlight unit to emit light by using the plurality of first control signals and the plurality of second control signal groups.

16 Claims, 6 Drawing Sheets

BACKLIGHT DRIVING METHOD, DISPLAY DRIVING METHOD, DRIVE DEVICE AND DISPLAY DEVICE

CROSS-REFERENCE TO RELATED PATENT APPLICATIONS

This application is a U.S. National Stage Application under 35 U.S.C. § 371 of International Patent Application No. PCT/CN2019/098702, filed Jul. 31, 2019, which is incorporated by reference in its entirety.

TECHNICAL FIELD

The embodiments of the present disclosure relate to a backlight driving method, a display driving method, a drive device and a display device.

BACKGROUND

Local dimming (LD) technology can divide the entire backlight unit into a plurality of backlight blocks that can be driven separately. Each backlight block includes one or a plurality of light-emitting diodes (LEDs). In accordance with the grayscale of different parts of a display image, the driving current of LEDs of backlight blocks corresponding to these parts is automatically adjusted to realize individual adjustment of the brightness of each block in the backlight unit, thereby improving the contrast of the display image.

SUMMARY

At least one embodiment of the present disclosure provides a backlight driving method of a backlight unit. The backlight unit includes a plurality of backlight blocks arranged in an array, a plurality of switching channels and a plurality of output channels, the plurality of backlight blocks include a plurality of rows of backlight blocks, the plurality of switching channels are respectively connected with the plurality of rows of backlight blocks, and the plurality of switching channels are configured to respectively and correspondingly provide first driving signals for the plurality of rows of backlight blocks under control of switching control signals; the plurality of backlight blocks include a plurality of columns of backlight blocks, the plurality of output channels are respectively connected with the plurality of columns of backlight blocks, and the plurality of output channels are configured to respectively and correspondingly provide second driving signals for the plurality of columns of backlight blocks under control of output control signals; the plurality of backlight blocks are configured to emit light under control of the switching control signals and the output control signals of a same frame. And the backlight driving method includes: receiving a frame of backlight data, wherein the frame of backlight data includes a plurality of first control signals, which are respectively applied to the plurality of switching channels and serve as the switching control signals, and includes a plurality of second control signal groups respectively corresponding to the plurality of first control signals, each of the plurality of second control signal groups includes a plurality of second control signals which are respectively applied to the plurality of output channels and serve as the output control signals, and the plurality of first control signals are modulated non-constant width pulse signals respectively; and driving the backlight unit to emit light by using the plurality of first control signals and the plurality of second control signal groups.

For example, in the backlight driving method provided by some embodiments of the present disclosure, a pulse width of each of the plurality of first control signals is equal to or greater than a maximum of pulse widths of the plurality of second control signals in a second control signal group corresponding to the each of the plurality of first control signals.

For example, in the backlight driving method provided by some embodiments of the present disclosure, the driving the backlight unit to emit light by using the plurality of first control signals and the plurality of second control signal groups includes: applying, during a scanning cycle corresponding to the frame of backlight data, the plurality of first control signals to the plurality of switching channels sequentially; and applying, during a time period of applying each of the plurality of first control signals, the plurality of second control signals in a second control signal group corresponding to the each of the plurality of first control signals to the plurality of output channels.

For example, in the backlight driving method provided by some embodiments of the present disclosure, a starting time point of each of the plurality of first control signals is fixed, a first time interval between the starting time points of adjacent first control signals is equal, and the first time interval is greater than a maximum pulse width of the plurality of first control signals.

For example, in the backlight driving method provided by some embodiments of the present disclosure, a count of the plurality of switching channels is N, the first time interval is less than or equal to 1/N of a time duration of the scanning cycle, and N is an integer greater than 1.

For example, in the backlight driving method provided by some embodiments of the present disclosure, a starting time point of the first control signal of a first switching channel is fixed, and except for the first switching channel, a second time interval between a starting time point of the first control signal of each of the remaining switching channels and an ending time point of the first control signal of a previous switching channel related to the each of the remaining switching channels is equal.

For example, in the backlight driving method provided by some embodiments of the present disclosure, a count of the plurality of switching channels is N, a sum of a maximum pulse width of the plurality of first control signals and the second time interval is equal to or less than 1/N of a time duration of the scanning cycle, and N is an integer greater than 1.

For example, the backlight driving method provided by some embodiments of the present disclosure further includes: receiving a next frame of backlight data during a scanning cycle of a current frame of backlight data.

At least one embodiment of the present disclosure further provides a display driving method of a display device. The display device includes a display panel and a backlight unit, the display panel includes a plurality of display blocks arranged in an array, the backlight unit includes a plurality of backlight blocks arranged in an array, a plurality of switching channels and a plurality of output channels, the plurality of backlight blocks are configured to respectively and correspondingly provide display light for the plurality of display blocks, the plurality of backlight blocks include a plurality of rows of backlight blocks, the plurality of switching channels are respectively connected with the plurality of rows of backlight blocks, and the plurality of switching channels are configured to respectively and correspondingly provide first driving signals for the plurality of rows of backlight blocks under control of switching control signals;

the plurality of backlight blocks include a plurality of columns of backlight blocks, the plurality of output channels are respectively connected with the plurality of columns of backlight blocks, and the plurality of output channels are configured to respectively and correspondingly provide second driving signals for the plurality of columns of backlight blocks under control of output control signals; the plurality of backlight blocks are configured to emit light under control of the switching control signals and the output control signals of a same frame. And the display driving method includes: obtaining a frame of backlight data according to image information of a frame of display image; and adopting the backlight driving method according to any one embodiment of the present disclosure to drive the backlight unit to emit light based on the frame of backlight data.

For example, in the display driving method provided by some embodiments of the present disclosure, the obtaining the frame of backlight data according to the image information of the frame of display image includes: obtaining a frame of display data according to the image information of the frame of display image, wherein the frame of display data includes display data of the plurality of display blocks; obtaining grayscale distribution information of each of the plurality of display blocks according to the display data of the plurality of display blocks; obtaining, according to the grayscale distribution information of each of the plurality of display blocks, a second control signal in backlight data of a backlight block corresponding to the each of the plurality of display blocks, and obtaining, according to a plurality of second control signals of each row of backlight blocks, a second control signal group corresponding to the each row of backlight blocks; and obtaining a pulse width of the first control signal of each of the plurality of switching channels according to pulse widths of the plurality of second control signals in the second control signal group corresponding to the each row of backlight blocks.

For example, the display driving method provided by some embodiments of the present disclosure further includes: upon driving the backlight unit to emit light based on the frame of backlight data, driving the display panel to display based on the frame of display data.

For example, the display driving method provided by some embodiments of the present disclosure further includes: receiving image information of a next frame of display image during a scanning cycle of a current frame of backlight data, and obtaining a next frame of backlight data according to the image information of the next frame of display image.

At least one embodiment of the present disclosure further provides a drive device which is applicable to a display panel and a backlight unit for the display panel. The display panel includes a plurality of display blocks arranged in an array, the backlight unit includes a plurality of backlight blocks arranged in an array, a plurality of switching channels and a plurality of output channels, the plurality of backlight blocks are configured to respectively and correspondingly provide display light for the plurality of display blocks, the plurality of backlight blocks include a plurality of rows of backlight blocks, the plurality of switching channels are respectively connected with the plurality of rows of backlight blocks, and the plurality of switching channels are configured to respectively and correspondingly provide first driving signals for the plurality of rows of backlight blocks under control of switching control signals; the plurality of backlight blocks include a plurality of columns of backlight blocks, the plurality of output channels are respectively connected with the plurality of columns of backlight blocks, and the plurality of output channels are configured to respectively and correspondingly provide second driving signals for the plurality of columns of backlight blocks under control of output control signals; the plurality of backlight blocks are configured to emit light under control of the switching control signals and the output control signals of a same frame. The drive device includes: a backlight data obtaining unit and a backlight control unit, wherein the backlight data obtaining unit is configured to obtaining a frame of backlight data according to image information of a frame of display image, the frame of backlight data includes a plurality of first control signals which are respectively applied to the plurality of switching channels and serve as the switching control signals, and includes a plurality of second control signal groups respectively corresponding to the plurality of first control signals, each of the plurality of second control signal groups includes a plurality of second control signals which are respectively applied to the plurality of output channels and serve as the output control signals, and the plurality of first control signals are modulated non-constant width pulse signals respectively; and the backlight control unit is configured to receive the frame of backlight data and to drive the backlight unit to emit light by using the plurality of first control signals and the plurality of second control signal groups included in the frame of backlight data.

For example, in the drive device provided by some embodiments of the present disclosure, the drive device further includes a display data obtaining unit, the backlight data obtaining unit includes a second control signal obtaining unit and a first control signal obtaining unit; the display data obtaining unit is configured to obtain, according to the image information of the frame of display image, a frame of display data which includes display data of the plurality of display blocks, and to obtain, according to display data of the plurality of display blocks, grayscale distribution information of each of the plurality of display blocks; the second control signal obtaining unit is configured to obtain, according to the grayscale distribution information of each of the plurality of display blocks, a second control signal of a backlight block corresponding to this display block, and to obtain, according to a plurality of second control signals of each row of backlight blocks, a second control signal group corresponding to the each row of backlight blocks; and the first control signal obtaining unit is configured to obtain a pulse width of the first control signal of each of the switching channels according to pulse widths of the plurality of second control signals in the second control signal group corresponding to the each row of backlight blocks.

For example, in the drive device provided by some embodiments of the present disclosure, a pulse width of each of the plurality of first control signals is equal to or greater than a maximum of pulse widths of the plurality of second control signals in a second control signal group corresponding to the each of the plurality of first control signals.

For example, the drive device provided by some embodiments of the present disclosure further includes: a display control unit, wherein the display control unit is configured to control the display panel to display based on the frame of display data upon the backlight control unit driving the backlight unit to emit light by using the plurality of first control signals and the plurality of second control signal groups.

For example, in the drive device provided by some embodiments of the present disclosure, the display data obtaining unit is further configured to receive image information of a next frame of display image during a scanning cycle of a current frame of backlight data, and to obtain a next frame of display data according to the image information of the next frame of display image; and the backlight data obtaining unit is further configured to obtain a next frame of backlight data according to the image information of the next frame of display image during the scanning cycle of the current frame of backlight data.

At least one embodiment of the present disclosure further provides a display device, including the display panel, the backlight unit and the drive device according to any one embodiment of the present disclosure, wherein the drive device is configured to control the backlight unit to emit light and control the display panel to display.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
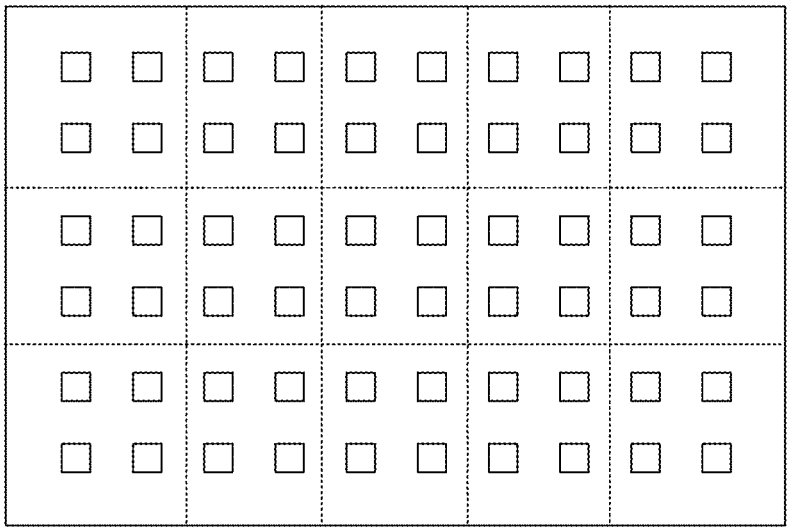
FIG. 1A is a schematic diagram of a backlight unit.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The present disclosure is described below with reference to specific embodiments. In order to keep the following description of the embodiments of the present disclosure clear and concise, detailed descriptions of known functions and known components or elements may be omitted. When any one component or element of an embodiment of the present disclosure appears in more than one of the accompanying drawings, the component or element is denoted by a same or similar reference numeral in each of the drawings.

A liquid crystal display (LCD) panel includes a liquid crystal panel and a backlight unit. Generally, the liquid crystal panel includes an array substrate and an opposite substrate (such as a color filter substrate) which are oppositely arranged to form a liquid crystal cell, and a liquid crystal layer is filled between the array substrate and the opposing substrate in the liquid crystal cell; a first polarizer is disposed on the array substrate; a second polarizer is disposed on the opposite substrate; and the polarization directions of the first polarizer and the second polarizer are perpendicular to each other. The backlight unit is disposed at a non-display side of the liquid crystal panel and configured to provide a planar source for the display of the liquid crystal panel. Under the action of the driving electric field formed between a pixel electrode of a subpixel disposed on the array substrate and a common electrodes disposed on the array substrate or a common electrode disposed on the opposite substrate, liquid crystal molecules of the liquid crystal layer are twisted. After the liquid crystal molecules are twisted by a predetermined angle, the polarization direction of light passing through the liquid crystal layer can be controlled, and the transmittance of the light can be controlled with the cooperation of the first polarizer and the second polarizer, thereby realizing grayscale display.

For instance, the backlight unit may be a direct-lit backlight unit or a side-lit backlight unit. For instance, the direct-lit backlight unit or the side-lit backlight unit can include a plurality of point sources (such as LEDs) which are arranged in parallel and a diffuser plate. Light emitted from the point sources is homogenized by the diffuser plate and then incident into the liquid crystal panel for display. For instance, the side-lit backlight unit can adopt global dimming technology to realize the overall brightness adjustment of the backlight unit, and the direct-lit backlight unit can adopt a progressive lighting technique to realize the brightness adjustment of the backlight unit.

At present, for instance, high-resolution LCD panels have been gradually applied to virtual reality (VR) devices. In the use process of a VR device, human eyes are closer to the display screen, and the display effect of a display image can be more easily perceived, so the requirements on the resolution and display quality of the display panel are getting higher and higher.

As the LD technology can not only reduce the power consumption of the display panel, but also realize the dynamic dimming of the backlight region, so that the contrast of the display image is greatly improved, and the display quality of the display panel is improved. Thus, as for the high-resolution LCD panel, the direct-lit backlight unit can be controlled by LD technology, so as to improve the display quality of the display panel to satisfy the requirement of the VR device on the display quality of the display panel.

For instance, the LD technology can divide the entire backlight unit into a plurality of backlight blocks that can be driven individually. Each backlight block includes one or a plurality of LEDs. In accordance with the grayscale required to be displayed for different parts of the display image, the driving current of LEDs of backlight blocks corresponding to these parts is automatically adjusted to realize individual adjustment of the brightness of each block in the backlight unit, thereby improving the contrast of the display image. Generally, the LD technology is merely applied to the direct-lit backlight unit, and a plurality of LEDs serving as light sources are, for instance, uniformly distributed in the entire back plate.

For instance, in an exemplary direct-lit backlight unit, a schematic diagram of divided regions of LED sources in an entire back plate is as shown in FIG. 1A. A small square in the figure represents one LED unit, and a plurality of regions separated by dashed lines represent a plurality of backlight blocks. Each backlight block includes one or a plurality of LED units and can be controlled independent of other backlight blocks. For instance, the plurality of LEDs in each backlight block are connected in series. That is to say, the current running through the plurality of LEDs disposed in the same backlight block is consistent, so the luminescent brightness thereof is basically consistent.

Figure 1B:
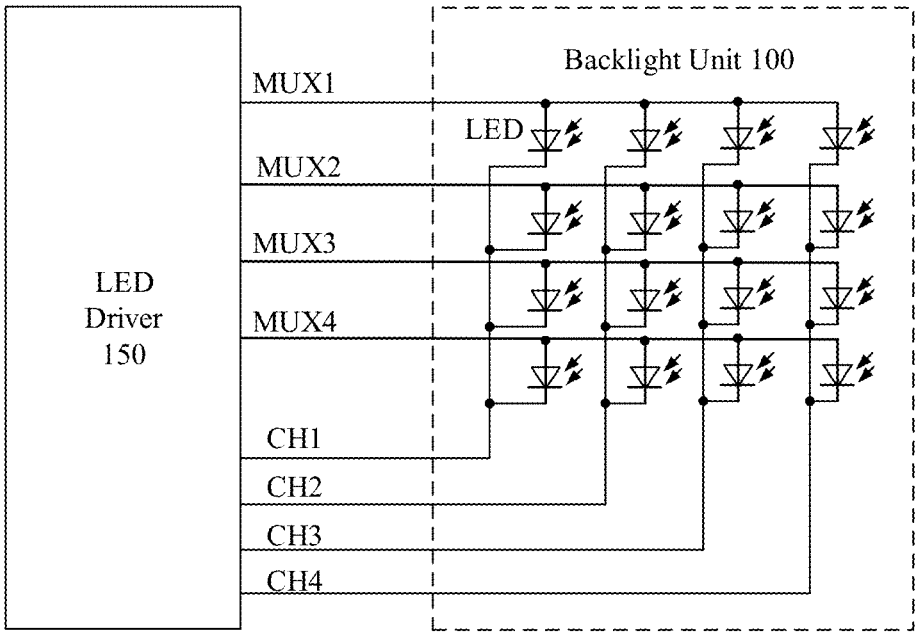
FIG. 1B is a schematic diagram of a drive architecture of a backlight unit.

FIG. 1B is a schematic diagram of a drive architecture of a backlight unit. As shown in FIG. 1B, the backlight unit 100 includes a plurality of backlight blocks. It should be noted that FIG. 1B only shows a backlight unit which includes backlight blocks of 4 rows and 4 columns, and each backlight block only includes one LED, but the present disclosure is not limited thereto. For instance, the backlight unit 100 can be driven by means of local dimming.

For instance, as shown in FIG. 1B, the backlight unit 100 can further include switching channels MUX1-MUX4 connected with LEDs in a plurality of rows of backlight blocks and output channels CH1-CH4 connected with LEDs in a plurality of columns of backlight blocks. The switching channels MUX1-MUX4 are turned on under the control of switching control signals, so as to correspondingly provide first driving signals (for instance, at a high voltage) for the LEDs in the plurality of rows of backlight blocks; the output channels CH1-CH4 are turned on under the control of output control signals, so as to correspondingly provide second driving signals (for instance, at a low voltage) for the LEDs in the plurality of columns of backlight blocks; and the LEDs in each backlight block are applied with a corresponding driving voltage (for instance, the driving voltage is a difference voltage between the first driving signal and the second driving signal) via the switching channel and the output channel which are connected with the LEDs, so a corresponding driving current flows through the LEDs and the LEDs emit light. For instance, the driving current outputted by the switching channels MUX1-MUX4 and the output channels CH1-CH4 can be obtained by a conventional algorithm in the prior art, and the turn-on time duration of the output channels CH1-CH4 can be obtained according to backlight data, thereby realizing local dimming.

For instance, as shown in FIG. 1B, an LED driver 150 can provide the switching control signals for the switching channels MUX1-MUX4 and provide the output control signals for the output channels CH1-CH4, so as to drive the LEDs in the backlight blocks to emit light. For instance, the backlight data include width configuration parameters of the output control signals of the output channels CH1-CH4.

Figure 1C:
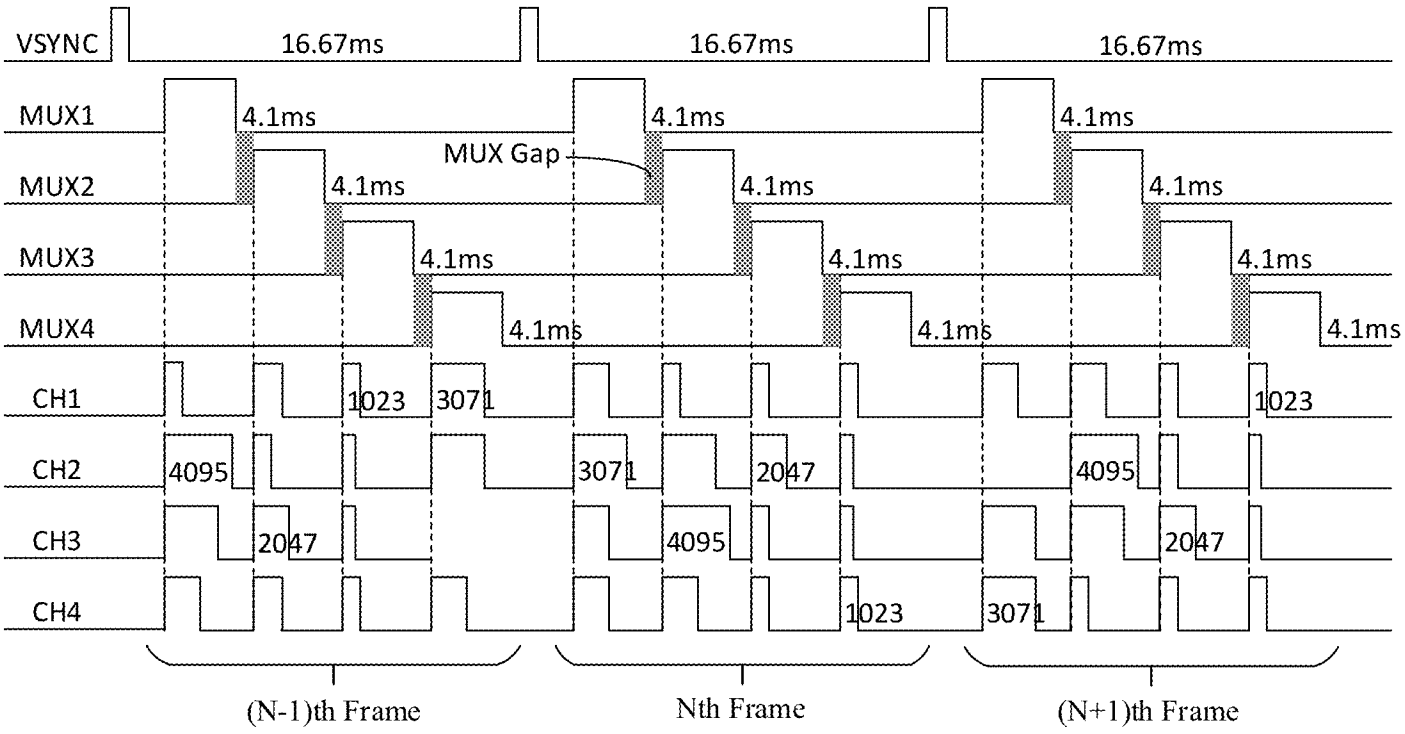
FIG. 1C is a timing chart for driving backlight blocks.

FIG. 1C is a timing chart for driving backlight blocks. The timing sequence shown in FIG. 1C can be applied to the drive architecture shown in FIG. 1B. As shown in FIG. 1C, a frame-by-frame scanning can be performed on the backlight unit 100 under the control of a vertical synchronization signal Vsync. Each frame of backlight data corresponds to one scanning cycle, and the time duration of the scanning cycle is the reciprocal of the refresh rate of the vertical synchronization signal Vsync. For instance, in the case where the refresh rate of the vertical synchronization signal Vsync is 60 Hz, the width (namely time duration) of each scanning cycle is 1/60 second (s), that is, approximately 16.67 millisecond (ms). It should be noted that the embodiments of the present disclosure are described by taking that the refresh rate is 60 Hz as an example, but the present disclosure is not limited to this case.

As shown in FIG. 1C, in each scanning cycle, the switching control signals are sequentially applied to the switching channels MUX1-MUX4, and meanwhile, the output control signals are provided to the output channels CH1-CH4 during the time period when each switching channel is turned on by the switching control signal, so as to realize the line-by-line scanning of the backlight blocks.

As shown in FIG. 1C, the output control signals of the output channels CH1-CH4 are pulse width modulation (PWM) signals, and the pulse width of a PWM signal is determined by the width configuration parameter of the output control signal in the backlight data. For instance, the PWM signal can be a 12-bit digital signal with a value range of 0-4095, or the PWM signal can be an 8-bit digital signal with a value range of 0-4095. It should be noted that the embodiments of the present disclosure are described by taking that the value range of the PWM signal is 0-255 as an example, but the present disclosure is not limited to this case. For instance, the value of the PWM signal corresponds to the pulse width of the PWM signal. For instance, the PWM signal has a value of 1023 corresponds to that the PWM signal has a pulse width of 1,023 microseconds (μs), and the PWM signal has a value of 2047 corresponds to that the PWM signal has a pulse width 2,047 μs. In this case, the maximum pulse width of the PWM signals is 4,096 μs, namely 4.096 ms. It should be noted that the PWM signals of the output channels CH1-CH4 of the (N−1)th frame, the Nth frame and the (N+1)th frame are all illustrative and should not be considered as a limitation to the present disclosure.

In the case of line-by-line scanning, the pulse widths of the switching control signals of the switching channels MUX-MUX4 should be equal to or greater than the maximum pulse width of the PWM signals, so as to ensure that each backlight block can emit light in full accordance with the PWM signals. For instance, as shown in FIG. 1C, in an initialization configuration, the pulse widths of the switching control signals of the switching channels MUX-MUX4 are set to be a constant average equal width, for instance, slightly greater than the maximum pulse width 4.096 ms of the PWM signals, for instance, about 4.1 ms (as shown in FIG. 1C). For instance, if the effect of the voltage slew rate of the switching control signal is ignored, that is, the time duration of the rising edge and that of the falling edge are ignored, the pulse widths of the switching control signals can be equal to the maximum pulse width of the PWM signals.

As shown in FIG. 1C, there is an inter-channel time interval between the switching control signals of adjacent switching channels, which is referred to as channel interval (i.e., MUX Gap, as shown by the shaded areas in FIG. 1C)) for short. For instance, the MUX Gap is generally set to be a constant average equal width. Due to are parasitic capacitances of the LEDs and the like in each backlight block, after the switching channels of one row of backlight blocks are turned off, the parasitic capacitances in the row of backlight blocks are discharged, and the MUX Gap is used for ensuring complete discharge. Thus, when LEDs in the next row of backlight blocks are illuminated, the LEDs in the previous row of backlight blocks will not emit light due to the incomplete discharge of the parasitic capacitances. However, under the condition that the time duration of the scanning cycle (about 16.67 ms) and the pulse width of the switching control signals (about 4.1 ms) are determined, the width of the MUX Gap generally can only be on the magnitude of several μs or tens of μs. In practical application, due to the small width of the MUX Gap, image ghost and other problems caused by incomplete discharge are easy to occur.

Moreover, the response time of the liquid crystal molecules in the LCD panel (namely the time from the beginning of the twisting of the liquid crystal molecules to the ending of the twisting when the liquid crystal molecules are stabilized at a predetermined angle) is long, and for instance, even the liquid crystal molecules have a rapid response function, the response time thereof is still 4-5 ms, and therefore, a dynamic blur phenomenon is easy to occur in the display process of the display panel. For instance, in a display device employing a side-lit backlight, black frame insertion technology (e.g., inserting one full-black frame between two or more adjacent frames) is usually adopted to avoid the problems of smearing and dynamic blur caused by liquid crystal twisting. However, different from the illumination method of the side-lit backlight unit, the direct-lit backlight unit usually adopts the driving method of illuminating the backlight blocks line by line, so that the black frame insertion technology is difficult to be applied thereto. Therefore, there is still no mature technology to solve the problems of dynamic blur and the like in the display process of the display device employing the direct-lit backlight unit.

At least one embodiment of the present disclosure provides a backlight driving method of a backlight unit. The backlight unit includes: a plurality of backlight blocks arranged in an array, a plurality of switching channels and a plurality of output channels. The plurality of backlight blocks include a plurality of rows of backlight blocks, the plurality of switching channels are respectively connected with the plurality of rows of backlight blocks, and the plurality of switching channels are configured to respectively and correspondingly provide first driving signals for the plurality of rows of backlight blocks under the control of switching control signals; the plurality of backlight blocks include a plurality of columns of backlight blocks, the plurality of output channels are respectively connected with the plurality of columns of backlight blocks, and the plurality of output channels are configured to respectively and correspondingly provide second driving signals for the plurality of columns of backlight blocks; and the plurality of backlight blocks are configured to emit light under the control of the switching control signals and the output control signals of a same frame. The backlight driving method includes: receiving a frame of backlight data, wherein the frame of backlight data includes a plurality of first control signals which are respectively applied to the plurality of switching channels and serve as the switching control signals, and includes a plurality of second control signal groups respectively corresponding to the plurality of first control signals, each of the plurality of second control signal groups includes a plurality of second control signals which are respectively applied to the plurality of output channels and serve as the output control signals, and the plurality of first control signals are modulated non-constant width pulse signals respectively; and driving the backlight unit to emit light by using the plurality of first control signals and the plurality of second control signal groups.

Some embodiments of the present disclosure further provide a display driving method, a drive device and a display device corresponding to the foregoing backlight driving method.

The backlight driving method, the display driving method, the drive device and the display device provided by at least one embodiment of the present disclosure can perform real-time configuration on the pulse widths of the switching control signals, thus can be used for increasing the time interval between adjacent switching control signals, so as to reduce the probability of the image ghost phenomenon, or can be used for increasing the time interval between adjacent frames in a probable way, so as to reduce the probability of the dynamic blur phenomenon.

Some embodiments of the present disclosure and examples thereof will be described in detail below with reference to the accompanying drawings.

Figure 2:
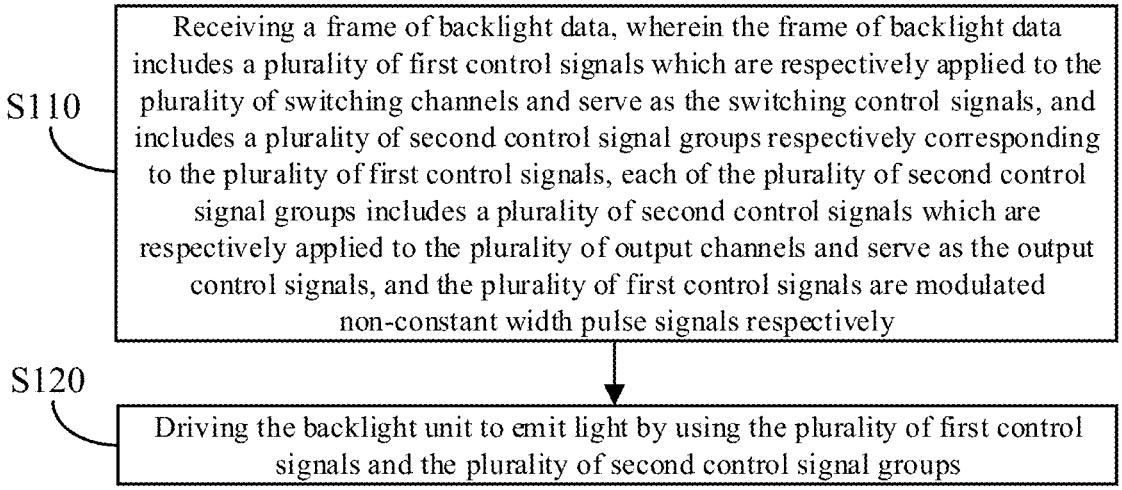
FIG. 2 is a flowchart of a backlight driving method of a backlight unit provided by at least one embodiment of the present disclosure.
Figure 3:
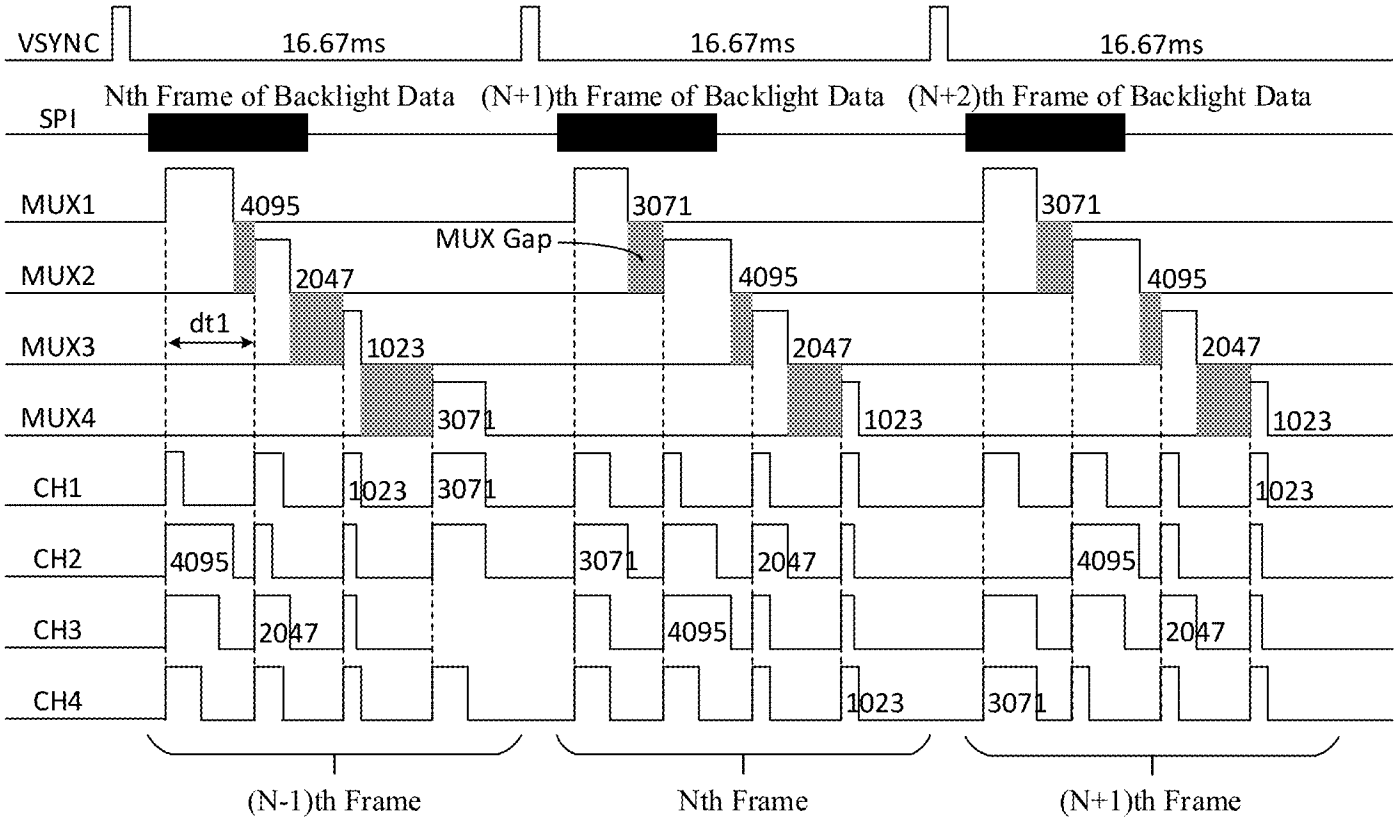
FIG. 3 is a timing chart for driving backlight blocks according to a backlight driving method provided by at least one embodiment of the present disclosure.

FIG. 2 is a flowchart of a backlight driving method of a backlight unit provided by at least one embodiment of the present disclosure. FIG. 3 is a timing chart for driving backlight blocks according to a backlight driving method provided by some embodiments of the present disclosure. For instance, the backlight unit can be referred to the backlight unit as shown in FIG. 1A and FIG. 1B, without being limited in the embodiments of the present disclosure. For instance, the backlight unit includes a plurality of backlight blocks which are arranged in an array, a plurality of switching channels and a plurality of output channels. For instance, each backlight block of the backlight unit includes one or a plurality of LEDs, and for instance, mini-LEDs (e.g., manufactured on a silicon substrate, with a device dimension of 10-100 μm) can be adopted.

For instance, as shown in FIG. 1B, the plurality of backlight blocks include a plurality of rows of backlight blocks, the plurality of switching channels (e.g., MUX1-MUX4 as shown in FIG. 1B) are respectively connected with the plurality of rows of backlight blocks, and the plurality of switching channels are configured to respectively and correspondingly provide first driving signals for the plurality of rows of backlight blocks under the control of switching control signals. For instance, the switching channels can be turned on by the switching control signals. For instance, the first driving signals are at a high voltage. For instance, the plurality of backlight blocks include a plurality of columns of backlight blocks, the plurality of output channels (e.g., CH1-CH4 as shown in FIG. 1B) are respectively connected with the plurality of columns of backlight blocks, and the plurality of output channels are configured to respectively and correspondingly provide second driving signals for the plurality of columns of backlight blocks under the control of output control signals. For instance, the output channels can be turned on by the output control signals. For instance, the second driving signals are at a low voltage. For instance, the LEDs in each backlight block are applied with a corresponding driving voltage (for instance, the driving voltage is a difference voltage between the first driving signal and the second driving signal) via the switching channel and the output channel connected with the LEDs, so a corresponding driving current flows through the LEDs and the LEDs emit light. For instance, at least one of the first driving signal or the second driving signal can be at a fixed level, without being limited in the embodiments of the present disclosure. For instance, the plurality of backlight blocks are configured to emit light under the control of the switching control signals and the output control signals of a same frame. For instance, in the case where both the switching channel and the output channel related to a backlight block are turned on, a corresponding driving current is provided, so that the backlight block emits light (namely the LEDs in the backlight block emit light).

The backlight driving method provided by the embodiments of the present disclosure will be described below by taking the backlight unit shown in FIG. 1B as an example and with reference to FIG. 2 and FIG. 3. It should be understood that the backlight driving method provided by the embodiments of the present disclosure is not only applicable to the backlight unit shown in FIG. 1B. Therefore, although the backlight unit shown in FIG. 1B is taken as an example, it should not be regarded as a limitation to the present disclosure.

As shown in FIG. 2, the backlight driving method includes steps S110 to S120.

Step S110: receiving a frame of backlight data, wherein the frame of backlight data includes a plurality of first control signals which are respectively applied to the plurality of switching channels and serve as the switching control signals, and includes a plurality of second control signal groups respectively corresponding to the plurality of first control signals, each of the plurality of second control signal groups includes a plurality of second control signals which are respectively applied to the plurality of output channels and serve as the output control signals, and the plurality of first control signals are modulated non-constant width pulse signals respectively.

For instance, in some examples, the frame of backlight data can be obtained according to image information of a frame of display image corresponding to the frame of backlight data. For instance, the second control signals in the second control signal groups can be obtained by a conventional algorithm in the prior art, and the first control signals can be obtained according to the second control signals in the second control signal groups corresponding thereto. For instance, in some examples, the frame of backlight data can be received by, for instance, the LED driver 150 as shown in FIG. 1B, and stored in a storage unit, such as a register, of the LED driver 150 so as to be used in the subsequent step S120. It should be noted that the embodiments of the present disclosure include this case, but are not limited thereto.

For instance, the timing sequences of the second control signals applied to the output channels CH1-CH4 as shown in FIG. 3 are the same as the timing sequences of the output control signals applied to the output channels CH1-CH4 as shown in FIG. 1C. For instance, the width configuration parameters of the second control signals in FIG. 3 and the width configuration parameters of the output control signal in FIG. 1C are obtained by the same algorithm according to the image information of the same display image.

For instance, in some examples, a pulse width of each first control signal is equal to or greater than the maximum of pulse widths of the plurality of second control signals in a second control signal group corresponding to the each first control signal. For instance, as shown in FIG. 3, without considering the effect of the voltage slew rate, taking the Nth frame as an example, the pulse width (e.g., 3,071) of the first control signal of the switching channel CH1 is equal to the maximum (e.g., 3,071) of the pulse widths of the plurality of second control signals (namely the second control signals of the output channels CH1-CH4) in the corresponding second control signal group; the pulse width (e.g., 4,095) of the first control signal of the switching channel CH2 is equal to the maximum (e.g., 4,095) of the pulse widths of the plurality of second control signals (namely the second control signals of the output channels CH1-CH4) in the corresponding second control signal group; the pulse width (e.g. 2,047) of the first control signal of the switching channel CH3 is equal to the maximum (e.g., 2,047) of the pulse widths of the plurality of second control signals (namely the second control signals of the output channels CH1-CH4) in the corresponding second control signal group; and the pulse width (e.g., 1,023) of the first control signal of the switching channel CH4 is equal to the maximum (e.g., 1,023) of the pulse widths of the plurality of second control signals (namely the second control signals of the output channels CH1-CH4) in the corresponding second control signal group. The cases of the (N−1)th frame and the (N+1)th frame are similar to that of the Nth frame, and no further description will be given here. It should be noted that the unit of the pulse widths of the first control signals and the second control signals in FIG. 3 is μs, and the specific values are all illustrative without being limited in the embodiments of the present disclosure.

For instance, the pulse width of the first control signal can also be set to be slightly greater than the maximum of the pulse widths of the plurality of second control signals in the corresponding second control signal group. For instance, the difference between the pulse width of the first control signal and the maximum of the pulse widths of the plurality of second control signals in the corresponding second control signal group is a constant value. For instance, the constant value is several μs or ten-odd μs or several tens of μs. Of course, the maximum of the pulse widths of the first control signals (namely the allowable maximum value of the pulse widths of the first control signals) should not be too large. For instance, under the condition that the time duration of the scanning cycle (about 16.67 ms) is determined, the maximum of the pulse widths of the first control signals should be at least less than 1/N of the time duration of the scanning cycle (for example, in the example as shown in FIG. 3, the maximum should be at least less than ¼ of the time duration of the scanning cycle), and N (N is an integer greater than 1) is the number of the switching channels, namely the number of rows of the plurality of rows of backlight blocks in the backlight unit.

Step S120: driving the backlight unit to emit light by using the plurality of first control signals and the plurality of second control signal groups.

For instance, in some examples, the backlight unit can be driven to emit light by using, for instance, the LED driver 150 as shown in FIG. 1B. It should be noted that the embodiments of the present disclosure include this case, but are not limited thereto.

For instance, in some examples, step S120 can include: applying, during the scanning cycle corresponding to the frame of backlight data, the plurality of first control signals to the plurality of switching channels sequentially; and applying, during the time period of applying each first control signal, the plurality of second control signals in a second control signal group corresponding to the each first control signal to the plurality of output channels. For instance, as shown in FIG. 3, taking the Nth frame as an example, during the scanning cycle corresponding to the Nth frame of backlight data, corresponding first control signals are sequentially applied to the switching channels MUX1-MUX4; and meanwhile, during the time period when applying each first control signal corresponding to each switching channel, the plurality of second control signals in the second control signal group corresponding to the each first control signal are applied to the output channels CH1-CH4. For instance, in some examples, as shown in FIG. 3, during the time period of applying each first control signal, the starting time points of the plurality of second control signals corresponding to the each first control signal can be the same, that is, the plurality of second control signals are synchronously applied. Moreover, for instance, the starting time points of the plurality of second control signals corresponding to the each first control signal are also the same as the starting time point of the each first control signal, that is, the each first control signal and the plurality of second control signals corresponding to the each first control signal are synchronously applied. It should be noted that the embodiments of the present disclosure include the above cases but are not limited thereto.

For instance, in some examples, as shown in FIG. 3, the starting time point of each first control signal is fixed, and a first time interval dt1 between the starting time points of adjacent first control signals is equal. For instance, the first time interval dt1 can also be constant. The case as shown in FIG. 1C is similar to this case, and the difference lies in that: in FIG. 1C, the pulse width of each switching control signal is constant and equal, so the image ghost phenomenon caused by small time duration of the MUX Gap may occur; and in FIG. 3, the pulse width of each first control signal is determined according to the pulse widths of the plurality of second control signals corresponding to the each first control signal, that is, each first control signal is a modulated signal. As shown in FIG. 3, the MUX Gap between adjacent first control signals is variable (as shown by the shaded areas in FIG. 3). Compared with the width of the MUX Gap as shown in FIG. 1C, the width of the MUX Gap as shown in FIG. 3 is significantly increased in most cases. For instance, in some cases as shown in FIG. 3, the width can be increased to be on the magnitude of several hundreds of μs and even ms. For instance, as shown in FIG. 3, in the case where the pulse width of a former first control signal is large, the width of the MUX Gap between the former first control signal and a latter first control signal (equal to the first time interval dt1 minus the pulse width of the former first control signal) is small; and in the case where the pulse width of the former first control signal is small, the width of the MUX Gap between the former first control signal and the latter first control signal is large. It should be understood that in most cases, the pulse widths of the second control signals in each second control signal group will not reach the maximum, so the pulse width of the first control signal will also not reach the maximum. Thus, the width of the MUX Gap can be increased in a probable way, and then the probability of the image ghost phenomenon can be reduced.

For instance, in some examples, as shown in FIG. 3, the first control signal of each switching channel corresponds to one first time interval, and in the case where the number of the plurality of switching channels is N, the first time interval dt1 should be less than or equal to 1/N of the time duration of the scanning cycle. Thus, the scanning of one frame of backlight data can be completed within one scanning cycle.

For instance, in some examples, the backlight driving method provided by the embodiment of the present disclosure further includes: receiving a next frame of backlight data during a scanning cycle of a current frame of backlight data.

For instance, as shown in FIG. 3, the Nth frame of backlight data is received during the scanning cycle of the (N−1)th frame; the (N+1)th frame of backlight data is received during the scanning cycle of the Nth frame; and the (N+2)th frame of backlight data is received during the scanning cycle of the (N+1)th frame. For instance, during the scanning cycle of the current frame of backlight data, the next frame of backlight data can be transmitted to, for example, the LED driver 150 as shown in FIG. 1B through a serial peripheral interface (SPI), and stored into a storage unit, such as a register, of the LED driver 150, so as to be used in the subsequent scanning cycle of the next frame of backlight data. For instance, in the backlight driving method as shown in FIG. 1C, the SPI only needs to transmit the width configuration parameters of the output control signals of the output channels. In contrast, in the backlight driving method as shown in FIG. 3, the SPI not only needs to transmit the width configuration parameters of the second control signals of the output channels, but also needs to transmit the width configuration parameters of the first control signals of the switching channels. The width configuration parameter of the first control signal of the switching channel is small in data size, and taking that the backlight unit includes 4 switching channels as an example, the SPI only needs to transmit 8 bytes more data, which has little effect on the processing speed of the SPI.

Figure 4:
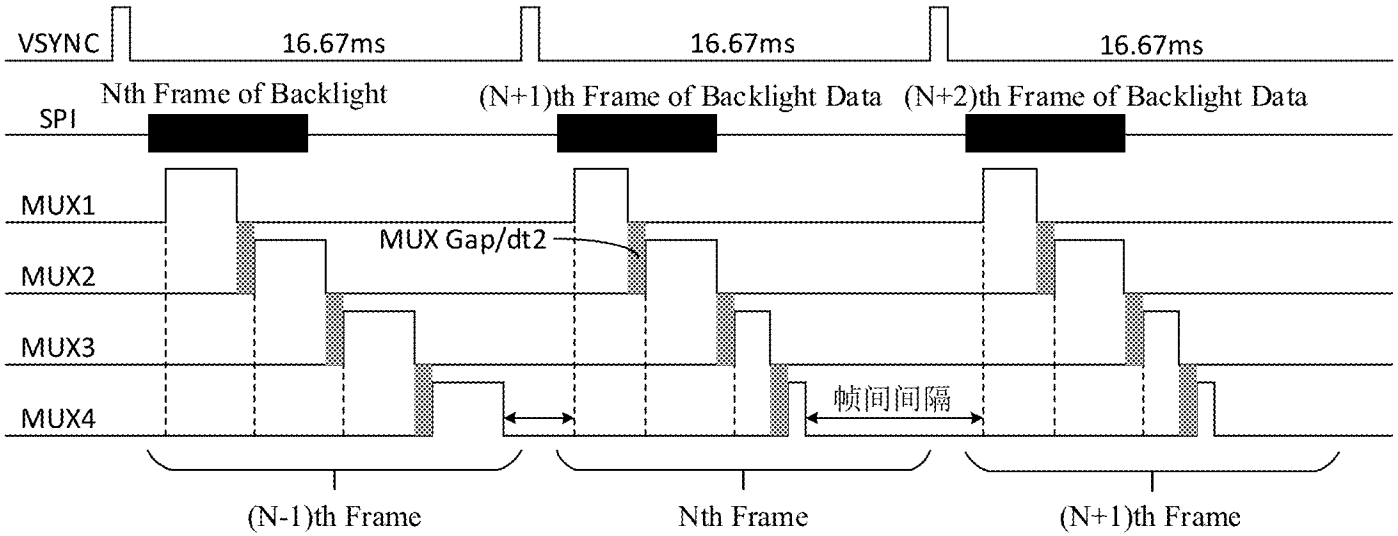
FIG. 4 is a timing chart for driving backlight blocks according to another backlight driving method provided by at least one embodiment of the present disclosure.

FIG. 4 is a timing chart for driving backlight blocks according to another backlight driving method provided by some embodiments of the present disclosure. The difference between the backlight driving method corresponding to the timing chart shown in FIG. 4 differs from the backlight driving method corresponding to the timing chart shown in FIG. 3 lies in that: in FIG. 4, the MUX Gap between the second control signals of adjacent switching channels is constant and has equal width (similar to the case of the MUX Gap as shown in FIG. 1C). Other aspects of the backlight driving method corresponding to the timing chart shown in FIG. 4 are basically the same as those of the backlight driving method corresponding to the timing chart shown in FIG. 3, and will not be repeated here. The difference mentioned above will be described in detail below with reference to FIG. 4.

For instance, in some examples, as shown in FIG. 4, the starting time point of the first control signal of the first switching channel MUX1 is fixed; and except for the first switching channel MUX1, a second time interval dt2 between the starting time point of the first control signal of each of the remaining switching channels (MUX2-MUX4) and the ending time point of the first control signal of a previous switching channel related to the each of the remaining switching channels is equal. For instance, the second time interval dt2 can also be constant. In this case, the second time interval dt2 is a MUX Gap. Therefore, the MUX Gap shown in FIG. 4 can be similar to the MUX Gap shown in FIG. 1C, and both have a constant average equal width. For instance, the width configuration parameter of the MUX Gap as shown in FIG. 4 can be referred to the width configuration parameter of the MUX Gap as shown in FIG. 1C, for instance, can be on the magnitude of several μs or tens of μs. Of course, the width of the second time interval dt2 should not be too large. For instance, under the condition that the time duration of the scanning cycle (about 16.67 ms) is determined, the sum of the maximum of the pulse width of the first control signal and the second time interval dt2 should be less than or equal to 1/N of the time duration of the scanning cycle (for instance, in the example as shown in FIG. 4, the maximum should be at least less than or equal to ¼ of the time duration of the scanning cycle), and N is the number of the switching channels, namely the number of rows of the plurality of rows of backlight blocks in the backlight unit.

For instance, as shown in FIG. 4, there is also an inter-frame time interval between two adjacent frames, which is referred to as frame gap (as shown by a bi-directional arrow in FIG. 4) for short. For instance, the time interval between the ending time point of the first control signal of the last switching channel of a former frame and the starting time point of the first control signal of the first switching channel of a latter frame can be defined as the frame gap. In FIG. 1C, the frame gap between adjacent frames is constant and has equal width. In FIG. 3, the frame gap between adjacent frames is modulated by the pulse width of the first control signal of the last switching channel of the former frame, but the variable range of the frame gap is relatively small. In FIG. 4, the frame gap between adjacent frames is modulated by the sum of the pulse widths of the first control signals of all the switching channels of the former frame, so the variable range of the frame gap is relatively large. For instance, as shown in FIG. 4, in the case where the sum of the pulse widths of the first control signals of all the switching channels of the former frame is large, the width of the frame gap between the former frame and the latter frame is small (as shown by the frame gap between the (N−1)th frame and the Nth frame in FIG. 4); and in the case where the sum of the pulse widths of the first control signals of all the switching channels of the former frame is small, the width of the frame gap between the former frame and the latter frame is large (as shown by the frame gap between the Nth frame and the (N+1)th frame in FIG. 4).

For instance, as shown in FIG. 4, in the (N−1)th frame, the pulse widths of the first control signals of the switching channels MUX1-MUX4 all reach the maximum (namely similar to the timing sequences in FIG. 1C), and the frame gap between the (N−1)th frame and the Nth frame is basically the same as the frame gap in FIG. 1C. It should be noted that the (N−1)th frame in FIG. 4 shows an extreme case, and for most frames, the values of the pulse widths of the first control signals of the switching channels MUX1-MUX4 can be considered as random (namely rarely reaching the maximum value at the same time), and for instance, the cases for most frames can be referred to the case as shown by the Nth frame. In this case, as shown in FIG. 4, the frame gap between the Nth frame and the (N+1)th frame is obviously increased compared with the frame gap in FIG. 1C. Therefore, it should be understood that in most cases, the backlight driving method corresponding to the timing chart shown in FIG. 4 can increase the width of the frame gap in a probable way, so as to achieve the effect similar to that of the black frame insertion technology (that is, the LEDs in the backlight unit do not emit light within a relatively wide frame gap), and further, the probability of the dynamic blur phenomenon can be reduced.

The backlight driving method provided by the above embodiments of the present disclosure can at least partially be implemented in the form of software, hardware, firmware or any combination thereof. The backlight driving method can perform real-time configuration on the pulse widths of the switching control signals, which can be used for increasing the time interval between adjacent switching control signals, so as to reduce the probability of the image ghost phenomenon, or can be used for increasing the time interval between adjacent frames in a probable way, so as to reduce the probability of the dynamic blur phenomenon.

Figure 5:
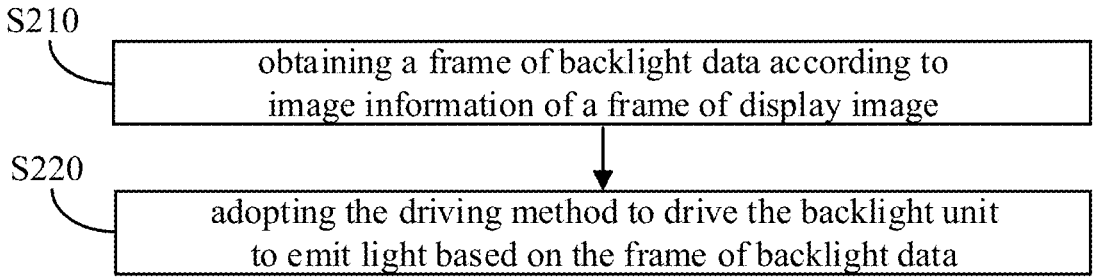
FIG. 5 is a flowchart of a display driving method of a display device provided by at least one embodiment of the present disclosure.

At least one embodiment of the present disclosure further provides a display driving method of a display device. FIG. 5 is a flowchart of the display driving method of a display device provided by at least one embodiment of the present disclosure.

For instance, the display device includes a display panel and a backlight unit. For instance, the display panel includes a plurality of display blocks arranged in an array, and each display block includes one or a plurality of subpixels. The backlight unit includes a plurality of backlight blocks which are arranged in an array, a plurality of switching channels and a plurality of output channels. For instance, the plurality of display blocks are in one-to-one correspondence with the plurality of backlight blocks, and the plurality of backlight blocks are configured to respectively and correspondingly provide display light for the plurality of display blocks. For instance, that a display block corresponds to a backlight block can be understood as that the backlight block and the subpixels in the display block are overlapped in the orthographic projection direction. For instance, each backlight block of the backlight unit includes one or a plurality of LEDs, and for instance, mini-LEDs (e.g., with a device dimension of 10-100 μm) can be adopted.

For instance, the backlight unit can be referred to the backlight unit as shown in FIG. 1A and FIG. 1B, without being limited in the embodiments of the present disclosure. For instance, as shown in FIG. 1B, the plurality of backlight blocks include a plurality of rows of backlight blocks, the plurality of switching channels (e.g., MUX1-MUX4 as shown in FIG. 1B) are respectively connected with the plurality of rows of backlight blocks, and the plurality of switching channels are configured to respectively and correspondingly provide first driving signals for the plurality of rows of backlight blocks under the control of switching control signals. For instance, the switching channels can be turned on by the switching control signals (namely the first control signals). For instance, the first driving signals are at a high voltage. For instance, the plurality of backlight blocks include a plurality of columns of backlight blocks, the plurality of output channels (e.g., CH1-CH4 as shown in FIG. 1B) are respectively connected with the plurality of columns of backlight blocks, and the plurality of output channels are configured to respectively and correspondingly provide second driving signals for the plurality of columns of backlight blocks under the control of output control signals. For instance, the output channels can be turned on by the output control signals (namely the second control signals). For instance, the second driving signals are at a low voltage. For instance, the LEDs in each backlight block are applied with a corresponding driving voltage (for instance, the driving voltage is a difference voltage between the first driving signal and the second driving signal) via the switching channel and the output channel connected with the LEDs, so a corresponding driving current flows through the LEDs and the LEDs emit light. For instance, at least one of the first driving signal or the second driving signal can be at a fixed level, without being limited in the embodiment of the present disclosure. For instance, the plurality of backlight blocks are configured to emit light under the control of the switching control signals and the output control signals of a same frame. For instance, in the case where the switching channel and the output channel related to a backlight block are simultaneously turned on, the backlight block emits light (that is, the LEDs in the backlight block emit light).

For instance, in response to a vertical synchronization signal (for instance, the vertical synchronization signal and the vertical synchronization signal Vsync in the foregoing backlight driving method are the same signal) of the display panel which indicates the start of one frame of image, liquid crystal molecules in subpixels of the display panel begin to twist under the action of the driving electric field applied between the pixel electrodes of the subpixels and the common electrode(s), and the display panel performs a normal display after the liquid crystal molecules complete the twisting. For instance, the foregoing backlight driving method can be adopted to drive the backlight unit to emit light. For instance, in some examples, when subpixels in one row of display blocks enter a normal display phase, one row of backlight blocks corresponding to this row of display blocks emit light, that is, the switching channels corresponding to this row of backlight blocks are turned on by the switching control signals (namely the first control signals), and meanwhile, the plurality of output channels are also respectively turned on by the output control signals (namely the second control signals).

For instance, the display device can be an LCD device or an electronic paper display device, etc. For instance, the display device can be a VR device, such as a virtual display helmet. For instance, the VR device can be in an integral form, and can also be in a split form, without being limited in the embodiments of the present disclosure. Correspondingly, the display panel of the display device can be an LCD panel or an electronic paper display panel, etc. For instance, the LCD panel can be in a vertical electric field type or a horizontal electric field type, etc. No limitation will be given to the specific structure and the type of the display panel (e.g., vertical electric field type LCD panel or horizontal electric field type LCD panel) in the embodiments of the present disclosure.

For instance, the LCD display device can further include a pixel array, a data decoding circuit, a timing controller, a gate driver, a data driver, a storage unit (such as a flash memory), etc. The pixel array includes a plurality of subpixels arranged in an array. These subpixels are arranged in multiple rows and multiple columns. The number of rows and the number of columns are relevant to the resolution of the display device. Each subpixel includes a pixel electrode. Each subpixel can further include a common electrode, or the plurality of subpixels share a same common electrode. The data decoding circuit receives display input signals and decodes the display input signals to obtain display data signals. The timing controller outputs timing sequence signals to control the synchronous operation of the gate driver and the data driver, etc., and can perform gamma correction on the display data signals and input the processed display data signals into the data driver for display operation. These components can be implemented by the conventional means. No limitation will be given here in the embodiments of the present disclosure, and no details will be given here.

The display driving method provided by the embodiments of the present disclosure will be described below with reference to FIG. 5. For instance, as shown in FIG. 5, the display driving method includes steps S210 to S220.

Step S210: obtaining a frame of backlight data according to image information of a frame of display image.

For instance, in some examples, the display device can further include a graphics processing unit (GPU), etc. For instance, the GPU can perform real-time image rendering to acquire the image information of the display image, and can further acquire backlight data for realizing the local dimming of the backlight blocks in the backlight unit according to a conventional algorithm in the prior art. It should be noted that the image information of the display image or the backlight data of the backlight unit can also be acquired by utilization of an application processor (AP), a timing controller (TCON), a central processing unit (CPU), a field programmable gate array (FPGA) or a processing unit of any other form having data processing capability and/or instruction execution capability together with corresponding computing instructions. No limitation will be given here in the embodiments of the present disclosure.

For instance, in some examples, step S210 can be implemented by the following process: obtaining a frame of display data according to the image information of the frame of display image, wherein the frame of display data includes display data of the plurality of display blocks; obtaining grayscale distribution information of each of the plurality of display blocks according to the display data of the plurality of display blocks; obtaining, according to the grayscale distribution information of each display block, a second control signal in backlight data of a backlight block corresponding to the each display block, and obtaining, according to the plurality of second control signals of each row of backlight blocks, a second control signal group corresponding to the each row of backlight blocks; and obtaining a pulse width of the first control signal of each of the plurality of switching channels according to pulse widths of the plurality of second control signals in the second control signal group corresponding to the each row of backlight blocks.

For instance, in the above process, the display data, the grayscale distribution information and the second control signals can all be obtained by the conventional algorithms in the prior art, and no further description will be given here. For instance, the acquisition method of the pulse width of the first control signal can be referred to relevant description of the foregoing backlight driving method, and no further description will be given here.

For instance, the frame of backlight data being obtained can be applied in the foregoing backlight driving method. For instance, the content and details of the frame of backlight data can be referred to relevant description of the above step S110, and no further description will be given here.

Step S220: adopting the driving method provided by any one embodiment of the present disclosure to drive the backlight unit to emit light based on the frame of backlight data.

For instance, the specific process and details of step S220 can be referred to relevant description of the above step S120 and FIG. 3 and FIG. 4, and no further description will be given here.

For instance, in some examples, the display driving method further includes: upon driving the backlight unit to emit light based on the frame of backlight data, driving the display panel to display based on the frame of display data. For instance, in some examples, as shown in FIG. 3 and FIG. 4, taking the display of the Nth frame of image as an example, during the scanning cycle of the Nth frame of backlight data, when the first switching channel MUX1 is turned on, the first row of backlight blocks corresponding to the first switching channel MUX1 emit light in response to the second control signals, and the first row of display blocks corresponding to the first row of backlight blocks enter a normal display phase; and when the first switching channel MUX1 is turned off (until the first switching channel is turned on during the scanning cycle of the next frame), the first row of backlight blocks do not emit light, and liquid crystal molecules in subpixels of the first row of display blocks can be twisted into, for instance, the initial state or any other state, so as to prepare for the display of the next frame of image. The corresponding cases of the turning on and off of the subsequent switching channels MUX2-MUX4 are similar to those of the first switching channel MUX1, and therefore, the line-by-line scanning of one frame of display image can be realized.

For instance, in some examples, as shown in FIG. 3 and FIG. 4, the backlight driving method of the backlight unit includes: receiving a next frame of backlight data during a scanning cycle of a current frame of backlight data. Correspondingly, the display driving method can include: receiving image information of a next frame of display image during a scanning cycle of a current frame of backlight data, and obtaining a next frame of backlight data according to the image information of the next frame of display image. And therefore, the requirement of the above backlight driving method can be satisfied.

It should be noted that the processes of the backlight driving method and the display driving method provided by the embodiments of the present disclosure can include more or fewer operations, and these operations can be performed sequentially or in parallel. Although the flow of the display driving method described above includes a plurality of operations occurring in a specific order, it should be clearly understood that the order of the plurality of operations is not limited. The backlight driving method and the display driving method described above can be executed once or multiple times according to a predetermined condition.

The display driving method provided by the embodiments of the present disclosure can be at least partially implemented in the form of software, hardware, firmware, or any combination thereof. The technical effects of the display driving method can be referred to the related description of the backlight driving method in the above embodiments, and no further description will be given here.

At least one embodiment of the present disclosure further provides a drive device. For instance, the drive device can be applied to a display panel and a backlight unit for the display panel, and for instance, the drive device can also be applied to the display device described in the foregoing display driving method. For instance, the drive device can be configured to execute the foregoing backlight driving method. Moreover, for instance, the drive device can also be configured to execute the foregoing display driving method.

For instance, the display panel includes a plurality of display blocks arranged in an array, and each display block includes one or a plurality of subpixels. The backlight unit includes a plurality of backlight blocks arranged in an array, a plurality of switching channels and a plurality of output channels. For instance, the plurality of display blocks are in one-to-one correspondence with the plurality of backlight blocks, and the plurality of backlight blocks are configured to respectively and correspondingly provide display light for the plurality of display blocks. For instance, that a display block corresponds to a backlight block can be understood as that the backlight block and the subpixels in the display block are overlapped in the orthographic projection direction. For instance, each backlight block of the backlight unit includes one or a plurality of LEDs, and for instance, mini-LEDs (e.g., with a device dimension of 10-100 μm) can be adopted.

For instance, the backlight unit can be referred to the backlight unit as shown in FIG. 1A and FIG. 1B, without being limited in the embodiments of the present disclosure. For instance, as shown in FIG. 1B, the plurality of backlight blocks include a plurality of rows of backlight blocks, the plurality of switching channels (e.g., MUX1-MUX4 as shown in FIG. 1B) are respectively connected with the plurality of rows of backlight blocks, and the plurality of switching channels are configured to respectively and correspondingly provide first driving signals for the plurality of rows of backlight blocks under the control of switching control signals. For instance, the switching channels can be turned on by the switching control signals (namely the first control signals). For instance, the first driving signals are at a high voltage. For instance, the plurality of backlight blocks include a plurality of columns of backlight blocks, the plurality of output channels (e.g., CH1-CH4 as shown in FIG. 1B) are respectively connected with the plurality of columns of backlight blocks, and the plurality of output channels are configured to respectively and correspondingly provide second driving signals for the plurality of columns of backlight blocks under the control of output control signals. For instance, the output channels can be turned on by the output control signals (namely the second control signals). For instance, the second driving signals are at a low voltage. For instance, the LEDs in each backlight block are applied with a corresponding driving voltage (for instance, the driving voltage is a difference voltage between the first driving signal and the second driving signal) via the switching channel and the output channel connected with the LEDs, so a corresponding driving current flows through the LEDs and the LEDs emit light. For instance, at least one of the first driving signal or the second driving signal can be at a fixed level, without being limited in the embodiment of the present disclosure. For instance, the plurality of backlight blocks are configured to emit light under the control of the switching control signals and the output control signals of a same frame. For instance, in the case where the switching channel and the output channel related to a backlight block are simultaneously turned on, the backlight block emits light (that is, the LEDs in the backlight block emit light).

Figure 6:
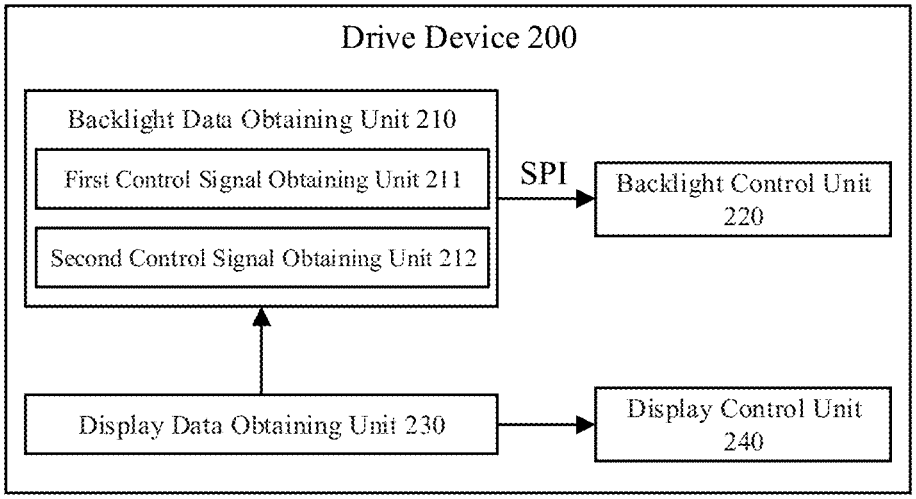
FIG. 6 is a schematic block diagram of a drive device provided by at least one embodiment of the present disclosure.

FIG. 6 is a schematic block diagram of a drive device provided by at least one embodiment of the present disclosure. As shown in FIG. 6, the drive device 200 comprises a backlight data obtaining unit 210 and a backlight control unit 220.

The backlight data obtaining unit 210 is configured to obtain a frame of backlight data according to image information of a frame of display image. For instance, the frame of backlight data includes a plurality of first control signals which are respectively applied to the plurality of switching channels and serve as the switching control signals, and includes a plurality of second control signal groups respectively corresponding to the plurality of first control signals, each of the plurality of second control signal groups includes a plurality of second control signals which are respectively applied to the plurality of output channels and serve as the output control signals, and the plurality of first control signals are modulated non-constant width pulse signals respectively. For instance, an implementation method of the function of the backlight data obtaining unit 210 can be referred to relevant description of the above step S210, and no further description will be given here. For instance, the backlight data obtaining unit 210 can be specifically implemented as a graphics processing unit (GPU), an application processor (AP), a timing controller (TCON), a central processing unit (CPU), a field programmable gate array (FPGA) or a processing unit of any other form having data processing capability and/or instruction execution capability together with corresponding computing instructions, without being limited in the embodiments of the present disclosure. For instance, the backlight data obtaining unit 210 can transmit the frame of backlight data to the backlight control unit 220 through a serial peripheral interface (SPI).

The backlight control unit 220 is configured to receive the frame of backlight data and to drive the backlight unit to emit light by using the plurality of first control signals and the plurality of second control signal groups included in the frame of backlight data. For instance, an implementation method of the function of the backlight control unit 220 can be referred to relevant description of the above steps S110 and S120, and no further description will be given here. For instance, the backlight control unit 220 can be specifically implemented as the LED driver 150 as shown in FIG. 1B, and the embodiments of the present disclosure include this case but are not limited thereto.

For instance, in some examples, as shown in FIG. 6, the drive device 200 can further include a display data obtaining unit 230. The display data obtaining unit 230 is configured to obtain a frame of display data according to the image information of the frame of display image. For instance, the frame of display data include display data of the plurality of display blocks. For instance, the display data obtaining unit 230 is further configured to obtain grayscale distribution information of each of the plurality of display blocks according to the display data of the plurality of display blocks. For instance, the display data obtaining unit 230 can adopt a conventional algorithm in the prior art to obtain the display data and the grayscale distribution information mentioned above. For instance, the display data obtaining unit 230 can also be specifically implemented as a graphics processing unit (GPU), an application processor (AP), a timing controller (TCON), a central processing unit (CPU), a field programmable gate array (FPGA) or a processing unit of any other form having data processing capability and/or instruction execution capability together with corresponding computing instructions, without being limited in the embodiments of the present disclosure. For instance, in some examples, the display data obtaining unit 230 and the backlight data obtaining unit 210 can be specifically implemented as a same processing unit, without being limited in the embodiments of the present disclosure.

For instance, in some examples, as shown in FIG. 6, the backlight data obtaining unit 210 can include a second control signal obtaining unit 212 and a first control signal obtaining unit 211.

For instance, the second control signal acquisition unit 212 is configured to obtain, according to the grayscale distribution information of each display block obtained by the display data obtaining unit 230, a second control signal of a backlight block corresponding to the each display block, and to obtain, according to the plurality of second control signals of each row of backlight blocks, a second control signal group corresponding to the each row of backlight blocks. For instance, the second control signal obtaining unit 212 can adopt a conventional algorithm in the prior art to obtain the second control signals described above.

For instance, the first control signal obtaining unit 211 is configured to obtain a pulse width of the first control signal of each of the switching channels according to the pulse widths of the plurality of second control signals in the second control signal group corresponding to the each row of backlight blocks. For instance, in some examples, the pulse width of each first control signal is equal to or greater than the maximum of the pulse widths of the plurality of second control signals in the corresponding second control signal group. For instance, the method and specific details of acquiring the pulse width of the first control signal by the first control signal obtaining unit 211 can be referred to relevant description of the above step S110, and no further description will be given here.

For instance, in some examples, as shown in FIG. 6, the drive device 200 can further include a display control unit 240. The display control unit 240 is configured to control the display panel to display based on the frame of display data upon the backlight control unit 220 driving the backlight unit to emit light by using the plurality of first control signals and the plurality of second control signal groups. For instance, an implementation method of the function of the display control unit 240 can be referred to relevant description of the foregoing display driving method, and no further description will be given here. For instance, in some examples, the display control unit 240 can receive the display data obtained by the display data obtaining unit 230 through a physical interface such as a high-definition multimedia interface (HDMI), convert the display data into mobile industry processor interface (MIPI) signals via a bridge chip, and transmit the MIPI signals to the display panel under the control of a vertical synchronization signal Vsync, so as to control liquid crystal molecules in the display panel to twist correspondingly.

For instance, in the backlight driving method provided by some examples, when scanning a frame of backlight data, the frame of backlight data needs to be obtained in advance. Therefore, the display data obtaining unit 230 can further be configured to receive image information of a next frame of display image during a scanning cycle of a current frame of backlight data, and to obtain a next frame of display data according to the image information of the next frame of display image; and meanwhile, the backlight data obtaining unit 210 is further configured to obtain a next frame of backlight data according to the image information of the next frame of display image during the scanning cycle of the current frame of backlight data.

It should be noted that in the drive device provided by the embodiments of the present disclosure, the obtaining units and the control units described above can be implemented in the form of hardware (such as a circuit), firmware, software or any combination thereof, and for instance, can be implemented as an integrated circuit (IC) chip. For instance, some units can be integrated into a same IC chip. It should be noted that the drive device provided by the embodiments of the present disclosure can include more or fewer circuits or units, and the connection relationships between the circuits or units are not limited and can be determined according to actual demands. The specific formation mode of each circuit is not limited. The circuit can be formed of analog elements according to the circuit principle, and can also be formed of digital chips, or in any other suitable ways.

The technical effects of the drive device provided by the embodiments of the present disclosure can be referred to the related description of the backlight driving method or the display driving method in the above embodiments. No further description will be given here.

Figure 7:
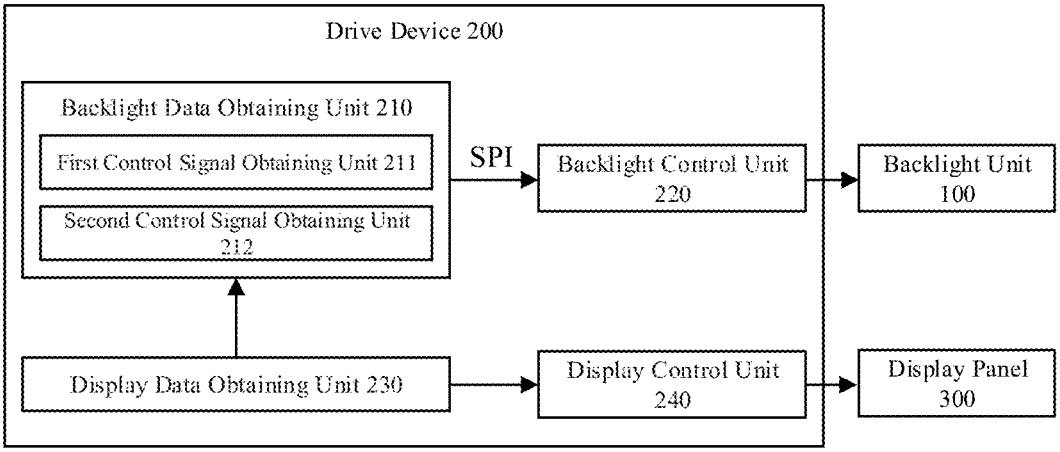
FIG. 7 is a schematic block diagram of a display device provided by at least one embodiment of the present disclosure.

At least one embodiment of the present disclosure further provides a display device. The display device comprises a display panel, a backlight unit and the drive device provided by any one embodiment of the present disclosure. FIG. 7 is a schematic block diagram of a display device provided by at least one embodiment of the present disclosure. As shown in FIG. 7, the display device comprises a drive device 200, a display panel 300 and a backlight unit 100.

For instance, in the display device as shown in FIG. 7, the drive device 200 can be the drive device provided by the above embodiments of the present disclosure, and for instance, can be the drive device as shown in FIG. 6. For instance, the display panel 300 and the backlight unit 100 can be referred to the display panel and the backlight unit in the embodiments of the above display device, without being limited in the embodiments of the present disclosure.

For instance, the drive device 200 is configured to control the backlight unit 100 to emit light and control the display panel 300 to display. For instance, the drive device 200 can adopt the display driving method provided by any one embodiment of the present disclosure to control the backlight unit 100 to emit light, and control the display panel 300 to display. For instance, a specific implementation method and the process can be referred to relevant description of the foregoing display driving method. No further description will be given here.

For instance, the display device provided by the embodiments of the present disclosure can be a product or component having a display function, such as a liquid crystal display, a television, an electronic paper display device, a mobile phone, a tablet computer, a notebook computer, a digital photo frame, a navigator, a virtual reality device, etc. It should be noted that the display device can further include other conventional components or structures. For instance, in order to realize necessary functions of the display device, those skilled in the art can set other conventional components or structures according to specific application scenarios, without being limited in the embodiments of the present disclosure.

The technical effects of the display device provided by at least one embodiment of the present disclosure can be referred to the related description of the backlight driving method or the display driving method in the above embodiments. No further description will be given here.

For the disclosure, the following statements should be noted:

(1) The accompanying drawings related to the embodiment(s) of the present disclosure involve only the structure(s) in connection with the embodiment(s) of the present disclosure, and other structure(s) can be referred to common design(s).

(2) In case of no conflict, the embodiments of the present disclosure and the features in the embodiments can be combined with each other to obtain new embodiments.

What have been described above are only specific implementations of the present disclosure, and the protection scope of the present disclosure is not limited thereto. Any changes or substitutions easily occur to those skilled in the art within the technical scope of the present disclosure should be covered in the protection scope of the present disclosure. Therefore, the protection scope of the present disclosure should be determined based on the protection scope of the claims

What is claimed is:

1. A backlight driving method of a backlight unit, wherein the backlight unit comprises a plurality of backlight blocks arranged in an array, a plurality of switching channels and a plurality of output channels, the plurality of backlight blocks comprise a plurality of rows of backlight blocks, the plurality of switching channels are respectively connected with the plurality of rows of backlight blocks, and the plurality of switching channels are configured to respectively and correspondingly provide first driving signals for the plurality of rows of backlight blocks under control of switching control signals;

the plurality of backlight blocks comprise a plurality of columns of backlight blocks, the plurality of output channels are respectively connected with the plurality of columns of backlight blocks, and the plurality of output channels are configured to respectively and correspondingly provide second driving signals for the plurality of columns of backlight blocks under control of output control signals;

the plurality of backlight blocks are configured to emit light under control of the switching control signals and the output control signals of a same frame; and the backlight driving method comprises:

receiving a frame of backlight data, wherein the frame of backlight data comprises a plurality of first control signals, which are respectively applied to the plurality of switching channels and serve as the switching control signals, and comprises a plurality of second control signal groups respectively corresponding to the plurality of first control signals, each of the plurality of second control signal groups comprises a plurality of second control signals which are respectively applied to the plurality of output channels and serve as the output control signals, and the plurality of first control signals are modulated non-constant width pulse signals respectively; and driving the backlight unit to emit light by using the plurality of first control signals and the plurality of second control signal groups;

wherein the driving the backlight unit to emit light by using the plurality of first control signals and the plurality of second control signal groups comprises:

applying, during a scanning cycle corresponding to the frame of backlight data, the plurality of first control signals to the plurality of switching channels sequentially; and applying, during a time period of applying each of the plurality of first control signals, the plurality of second control signals in a second control signal group corresponding to the each of the plurality of first control signals to the plurality of output channels;

wherein a starting time point of each of the plurality of first control signals is fixed, a first time interval between the starting time points of adjacent first control signals is equal, and the first time interval is greater than a maximum pulse width of the plurality of first control signals, a count of the plurality of switching channels is N, the first time interval is less than or equal to 1/N of a time duration of the scanning cycle, and N is an integer greater than 1; or, a starting time point of the first control signal of a first switching channel is fixed, and except for the first switching channel, a second time interval between a starting time point of the first control signal of each of the remaining switching channels and an ending time point of the first control signal of a previous switching channel related to the each of the remaining switching channels is equal.

2. The backlight driving method according to claim 1, wherein a pulse width of each of the plurality of first control signals is equal to or greater than a maximum of pulse widths of the plurality of second control signals in a second control signal group corresponding to the each of the plurality of first control signals.

3. The backlight driving method according to claim 1, wherein a count of the plurality of switching channels is N, a sum of a maximum pulse width of the plurality of first control signals and the second time interval is equal to or less than 1/N of a time duration of the scanning cycle, and N is an integer greater than 1.

4. The backlight driving method according to claim 1, further comprising:

receiving a next frame of backlight data during a scanning cycle of a current frame of backlight data.

5. A display driving method of a display device, wherein the display device comprises a display panel and a backlight unit, the display panel comprises a plurality of display blocks arranged in an array, the backlight unit comprises a plurality of backlight blocks arranged in an array, a plurality of switching channels and a plurality of output channels, the plurality of backlight blocks are configured to respectively and correspondingly provide display light for the plurality of display blocks, the plurality of backlight blocks comprise a plurality of rows of backlight blocks, the plurality of switching channels are respectively connected with the plurality of rows of backlight blocks, and the plurality of switching channels are configured to respectively and correspondingly provide first driving signals for the plurality of rows of backlight blocks under control of switching control signals;

the plurality of backlight blocks comprise a plurality of columns of backlight blocks, the plurality of output channels are respectively connected with the plurality of columns of backlight blocks, and the plurality of output channels are configured to respectively and correspondingly provide second driving signals for the plurality of columns of backlight blocks under control of output control signals;

the plurality of backlight blocks are configured to emit light under control of the switching control signals and the output control signals of a same frame; and the display driving method comprises:

obtaining a frame of backlight data according to image information of a frame of display image; and adopting the backlight driving method according to claim 1 to drive the backlight unit to emit light based on the frame of backlight data.

6. The display driving method according to claim 5, wherein the obtaining the frame of backlight data according to the image information of the frame of display image comprises:

obtaining a frame of display data according to the image information of the frame of display image, wherein the frame of display data comprises display data of the plurality of display blocks;

obtaining grayscale distribution information of each of the plurality of display blocks according to the display data of the plurality of display blocks;

obtaining, according to the grayscale distribution information of each of the plurality of display blocks, a second control signal in backlight data of a backlight block corresponding to the each of the plurality of display blocks, and obtaining, according to a plurality of second control signals of each row of backlight blocks, a second control signal group corresponding to the each row of backlight blocks; and obtaining a pulse width of the first control signal of each of the plurality of switching channels according to pulse widths of the plurality of second control signals in the second control signal group corresponding to the each row of backlight blocks.

7. The display driving method according to claim 6, further comprising:

upon driving the backlight unit to emit light based on the frame of backlight data, driving the display panel to display based on the frame of display data.

8. The display driving method according to claim 5, further comprising:

receiving image information of a next frame of display image during a scanning cycle of a current frame of backlight data, and obtaining a next frame of backlight data according to the image information of the next frame of display image.

9. The display driving method according to claim 5, wherein a pulse width of each of the plurality of first control signals is equal to or greater than a maximum of pulse widths of the plurality of second control signals in a second control signal group corresponding to the each of the plurality of first control signals.

10. The display driving method according to claim 8, further comprising: obtaining a next frame of display data according to the image information of the next frame of display image.

11. A drive device, applicable to a display panel and a backlight unit for the display panel, wherein the display panel comprises a plurality of display blocks arranged in an array, the backlight unit comprises a plurality of backlight blocks arranged in an array, a plurality of switching channels and a plurality of output channels, the plurality of backlight blocks are configured to respectively and correspondingly provide display light for the plurality of display blocks, the plurality of backlight blocks comprise a plurality of rows of backlight blocks, the plurality of switching channels are respectively connected with the plurality of rows of backlight blocks, and the plurality of switching channels are configured to respectively and correspondingly provide first driving signals for the plurality of rows of backlight blocks under control of switching control signals;

the plurality of backlight blocks comprise a plurality of columns of backlight blocks, the plurality of output channels are respectively connected with the plurality of columns of backlight blocks, and the plurality of output channels are configured to respectively and correspondingly provide second driving signals for the plurality of columns of backlight blocks under control of output control signals;

the plurality of backlight blocks are configured to emit light under control of the switching control signals and the output control signals of a same frame;

the drive device comprises: a backlight data obtaining unit and a backlight control unit, wherein the backlight data obtaining unit is configured to obtaining a frame of backlight data according to image information of a frame of display image, the frame of backlight data comprises a plurality of first control signals which are respectively applied to the plurality of switching channels and serve as the switching control signals, and comprises a plurality of second control signal groups respectively corresponding to the plurality of first control signals, each of the plurality of second control signal groups comprises a plurality of second control signals which are respectively applied to the plurality of output channels and serve as the output control signals, and the plurality of first control signals are modulated non-constant width pulse signals respectively; and the backlight control unit is configured to receive the frame of backlight data and to drive the backlight unit to emit light by using the plurality of first control signals and the plurality of second control signal groups included in the frame of backlight data;

wherein the driving the backlight unit to emit light by using the plurality of first control signals and the plurality of second control signal groups comprises:

applying, during a scanning cycle corresponding to the frame of backlight data, the plurality of first control signals to the plurality of switching channels sequentially; and applying, during a time period of applying each of the plurality of first control signals, the plurality of second control signals in a second control signal group corresponding to the each of the plurality of first control signals to the plurality of output channels;

wherein a starting time point of each of the plurality of first control signals is fixed, a first time interval between the starting time points of adjacent first control signals is equal, and the first time interval is greater than a maximum pulse width of the plurality of first control signals, a count of the plurality of switching channels is N, the first time interval is less than or equal to 1/N of a time duration of the scanning cycle, and N is an integer greater than 1; or, a starting time point of the first control signal of a first switching channel is fixed, and except for the first switching channel, a second time interval between a starting time point of the first control signal of each of the remaining switching channels and an ending time point of the first control signal of a previous switching channel related to the each of the remaining switching channels is equal.

12. A display device, comprising: the display panel, the backlight unit and the drive device according to claim 11, wherein the drive device is configured to control the backlight unit to emit light and control the display panel to display.

13. A drive device, applicable to a display panel and a backlight unit for the display panel, wherein the display panel comprises a plurality of display blocks arranged in an array, the backlight unit comprises a plurality of backlight blocks arranged in an array, a plurality of switching channels and a plurality of output channels, the plurality of backlight blocks are configured to respectively and correspondingly provide display light for the plurality of display blocks, the plurality of backlight blocks comprise a plurality of rows of backlight blocks, the plurality of switching channels are respectively connected with the plurality of rows of backlight blocks, and the plurality of switching channels are configured to respectively and correspondingly provide first driving signals for the plurality of rows of backlight blocks under control of switching control signals;

the plurality of backlight blocks comprise a plurality of columns of backlight blocks, the plurality of output channels are respectively connected with the plurality of columns of backlight blocks, and the plurality of output channels are configured to respectively and correspondingly provide second driving signals for the plurality of columns of backlight blocks under control of output control signals;

the plurality of backlight blocks are configured to emit light under control of the switching control signals and the output control signals of a same frame;

the drive device comprises: a backlight data obtaining unit and a backlight control unit, wherein the backlight data obtaining unit is configured to obtaining a frame of backlight data according to image information of a frame of display image, the frame of backlight data comprises a plurality of first control signals which are respectively applied to the plurality of switching channels and serve as the switching control signals, and comprises a plurality of second control signal groups respectively corresponding to the plurality of first control signals, each of the plurality of second control signal groups comprises a plurality of second control signals which are respectively applied to the plurality of output channels and serve as the output control signals, and the plurality of first control signals are modulated non-constant width pulse signals respectively; and the backlight control unit is configured to receive the frame of backlight data and to drive the backlight unit to emit light by using the plurality of first control signals and the plurality of second control signal groups included in the frame of backlight data;

wherein the drive device further comprises a display data obtaining unit, the backlight data obtaining unit comprises a second control signal obtaining unit and a first control signal obtaining unit;

the display data obtaining unit is configured to obtain, according to the image information of the frame of display image, a frame of display data which comprises display data of the plurality of display blocks, and to obtain, according to display data of the plurality of display blocks, grayscale distribution information of each of the plurality of display blocks;

the second control signal obtaining unit is configured to obtain, according to the grayscale distribution information of each of the plurality of display blocks, a second control signal of a backlight block corresponding to this display block, and to obtain, according to a plurality of second control signals of each row of backlight blocks, a second control signal group corresponding to the each row of backlight blocks; and the first control signal obtaining unit is configured to obtain a pulse width of the first control signal of each of the switching channels according to pulse widths of the plurality of second control signals in the second control signal group corresponding to the each row of backlight blocks.

14. The drive device according to claim 13, wherein a pulse width of each of the plurality of first control signals is equal to or greater than a maximum of pulse widths of the plurality of second control signals in a second control signal group corresponding to the each of the plurality of first control signals.

15. The drive device according to claim 13, further comprising: a display control circuit, wherein the display control circuit is configured to control the display panel to display based on the frame of display data upon the backlight control unit driving the backlight unit to emit light by using the plurality of first control signals and the plurality of second control signal groups.

16. The drive device according to claim 13, wherein the display data obtaining unit is further configured to receive image information of a next frame of display image during a scanning cycle of a current frame of backlight data, and to obtain a next frame of display data according to the image information of the next frame of display image; and the backlight data obtaining unit is further configured to obtain a next frame of backlight data according to the image information of the next frame of display image during the scanning cycle of the current frame of backlight data.

* * * * *